US011497285B2

(12) United States Patent
Songhorian

(10) Patent No.: US 11,497,285 B2
(45) Date of Patent: Nov. 15, 2022

(54) HANDS-FREE, AUTOMATIC UMBRELLA WITH LIGHTING MECHANISM AND ROTATING DEVICE FOR ELECTRICITY GENERATION FROM WIND

(71) Applicant: Roya Songhorian, Great Neck, NY (US)

(72) Inventor: Roya Songhorian, Great Neck, NY (US)

(73) Assignee: Roya Songhorian, Great Neck, NY (US)

( * ) Notice: Subject to any disclaimer, the term of this patent is extended or adjusted under 35 U.S.C. 154(b) by 135 days.

(21) Appl. No.: 17/088,856

(22) Filed: Nov. 4, 2020

(65) Prior Publication Data

US 2022/0133005 A1 May 5, 2022

(51) Int. Cl.

| | |
|---|---|
| ***A45B 11/02*** | (2006.01) |
| ***A45B 25/14*** | (2006.01) |
| ***A45B 3/04*** | (2006.01) |

(52) U.S. Cl.

CPC ..... *A45B 25/143* (2013.01); *A45B 3/04* (2013.01); *A45B 11/02* (2013.01); *A45B 2200/1018* (2013.01)

(58) Field of Classification Search

CPC ..... A45B 11/02; A45B 2019/008; A45B 2200/1018; F04D 19/002

See application file for complete search history.

(56) References Cited

U.S. PATENT DOCUMENTS

| | | | | |
|---|---|---|---|---|
| 1,166,272 | A * | 12/1915 | Smithings | A45B 3/04 135/910 |
| 3,204,650 | A | 9/1965 | Shinew | |
| 5,020,557 | A | 6/1991 | Apple | |
| D330,455 | S | 10/1992 | Massie | |
| 5,263,837 | A | 11/1993 | Dompe | |
| 5,318,055 | A | 6/1994 | Olaniyan | |
| 5,409,291 | A | 4/1995 | Lamb et al. | |
| 5,449,012 | A | 9/1995 | Friedman | |
| 5,513,786 | A | 5/1996 | Drane | |
| 6,247,482 | B1 | 6/2001 | Muis | |
| 7,069,939 | B1 | 7/2006 | Conde | |
| 8,069,868 | B2 | 12/2011 | Kuelbs | |

(Continued)

FOREIGN PATENT DOCUMENTS

| | | |
|---|---|---|
| CN | 2092235 U | 1/1992 |
| CN | 1206575 A | 2/1999 |

(Continued)

*Primary Examiner* — Noah Chandler Hawk

(74) *Attorney, Agent, or Firm* — Venable LLP

(57) ABSTRACT

An umbrella assembly comprises a container, at least one shoulder strap, and an umbrella. The umbrella is movably connected to the container to move between a closed position and open position. The umbrella includes a fixed shaft, a stretcher frame, and a canopy, and the canopy of the umbrella is attached to a plurality of ribs of the stretcher frame. In the closed position, the umbrella has a V-shaped, cone arrangement. In the open position, the umbrella has a peak on which a rotating device may be mounted to generate electricity. The umbrella may also have a first lighting mechanism fixed on a bottom side of the canopy and a second lighting mechanism fixed on a top side of the canopy.

20 Claims, 8 Drawing Sheets

(56) References Cited

U.S. PATENT DOCUMENTS

| | | | | |
|---|---|---|---|---|
| 8,556,141 | B1 | 10/2013 | Ferraiolo | |
| 8,733,378 | B2 | 5/2014 | Tayebi | |
| 8,944,300 | B1 | 2/2015 | Kaufman | |
| 9,526,306 | B2 | 12/2016 | Fitzgerald et al. | |
| 2001/0035202 | A1 | 11/2001 | Moskowitz et al. | |
| 2005/0172986 | A1 | 8/2005 | Lu | |
| 2006/0076374 | A1 | 4/2006 | Jennings | |
| 2007/0189002 | A1* | 8/2007 | Thode | A45B 3/04 362/102 |
| 2010/0313922 | A1 | 12/2010 | Raider | |
| 2012/0325278 | A1 | 12/2012 | Kuelbs | |
| 2013/0092715 | A1 | 4/2013 | Tayebi | |

FOREIGN PATENT DOCUMENTS

| | | | | |
|---|---|---|---|---|
| CN | 201332765 | Y * | 10/2009 | A45B 25/143 |
| CN | 204105080 | U | 1/2015 | |
| CN | 207428606 | U | 6/2018 | |
| WO | 2016011855 | A1 | 1/2016 | |

* cited by examiner

HANDS-FREE, AUTOMATIC UMBRELLA WITH LIGHTING MECHANISM AND ROTATING DEVICE FOR ELECTRICITY GENERATION FROM WIND

FIELD OF THE INVENTION

The invention relates to umbrella assemblies, particularly an improved umbrella assembly that is automatic, rotatable, consists of at least one lighting mechanism and a rotating device for electricity generation from wind.

BACKGROUND OF THE INVENTION

Umbrellas are used to protect users from dangerous weather conditions such as rain, snow, hail, and other forms of precipitation. However, umbrellas must conventionally be carried by users, which can be inconvenient, burdensome, and oftentimes unsafe. Therefore, it is desirable to have a hands-free, automatic umbrella assembly that further includes additional features that maximize visibility by alerting vehicle drivers, bicyclists, and other pedestrians of the presence of the user and by improving the visibility of the user, particularly at night, during precipitation, and other unsafe conditions.

SUMMARY OF THE INVENTION

In one aspect, the invention relates to an umbrella assembly including a container, at least one shoulder strap, and an umbrella. The container has a top and a bottom. The shoulder strap(s) are attached to the container and are capable of harnessing the container onto the shoulders of the user. The umbrella is movably connected to the container to move between a closed position and open position. The umbrella includes a fixed shaft, a stretcher frame, and a canopy. In the closed position, the umbrella has a V-shaped, cone arrangement. In the open position, the umbrella has a peak on which a rotating device is mounted to generate electricity.

In another aspect, the invention relates to an umbrella assembly including a container, at least one shoulder strap, and an umbrella. The container has a top and a bottom. The shoulder strap(s) are attached to the container and are capable of harnessing the container onto the shoulders of the user. The umbrella is movably connected to the container to move between a closed position and open position. The umbrella includes a fixed shaft, a stretcher frame, and a canopy. The canopy is attached to a plurality of ribs of the stretcher frame. The canopy has a perimeter, a top side, and a bottom side. The umbrella has a first lighting mechanism fixed on the bottom side of the canopy. The umbrella has a second lighting mechanism fixed on the top side of the canopy.

These and other aspects of the invention will become apparent from the following disclosure.

BRIEF DESCRIPTION OF THE DRAWINGS

FIG. 2A illustrates the umbrella in the closed position with a V-shaped, cone arrangement. FIG. 2B illustrates the umbrella in a partially open position and partially closed position. FIG. 2C illustrates the umbrella in the open position.

DETAILED DESCRIPTION OF THE PREFERRED EMBODIMENTS

The present invention relates to an umbrella assembly, particularly one that operates hands-free. By automatically expanding and contracting, the umbrella assembly permits a user to retain use of both hands while still being protected from rain, snow, hail, and other forms of precipitation by an umbrella.

Figure 1:
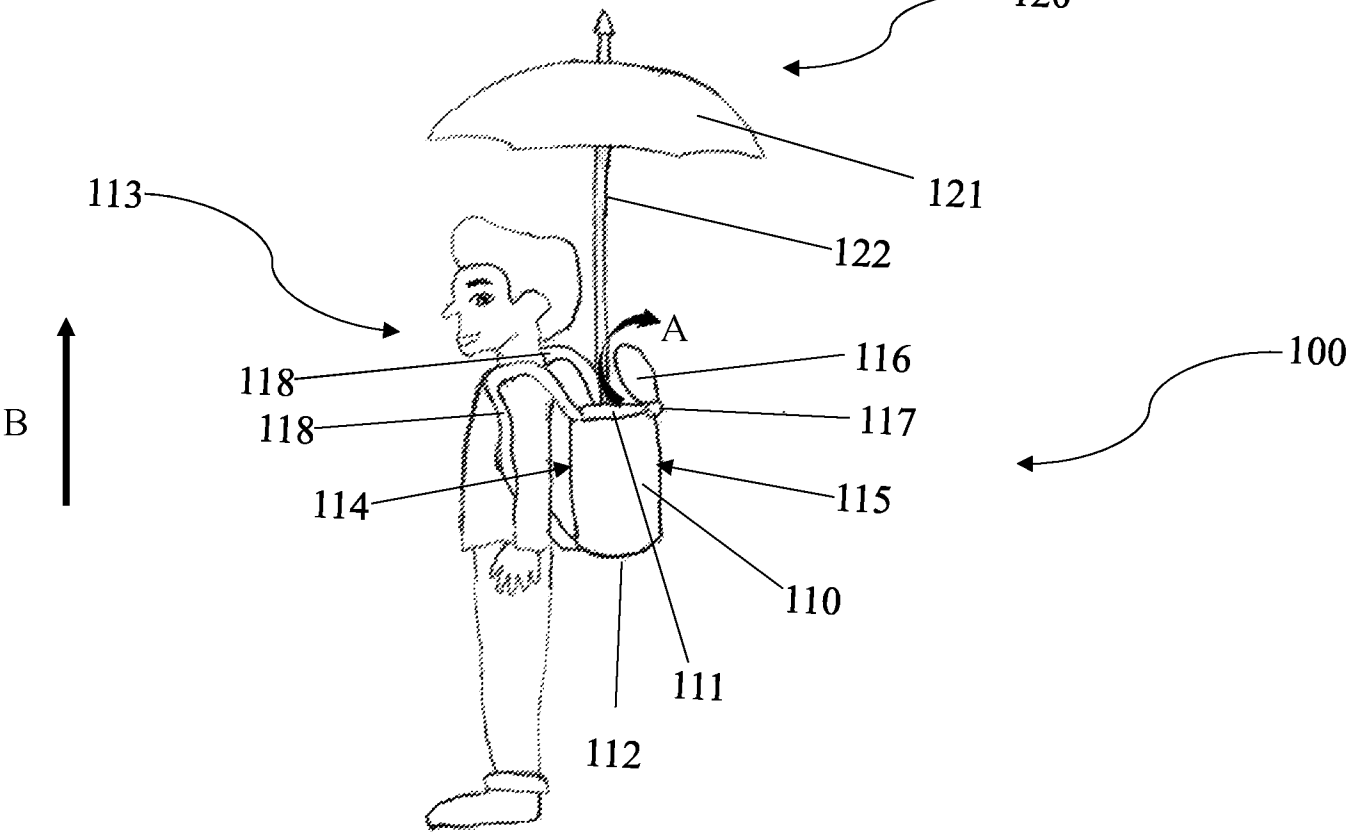
FIG. 1 illustrates a side view of the umbrella assembly in accordance with a preferred embodiment of the invention.

FIG. 1 shows a side view of an umbrella assembly 100 in accordance with an embodiment of the present invention. The umbrella assembly 100 includes a container 110 and an umbrella 120. The umbrella 120 moves between an open position and a closed position, as will be described more fully below with respect to FIGS. 2A-2C. The umbrella assembly 100 in FIG. 1 is shown with the umbrella 120 in the open position.

The container 110 is used to house, store, and protect the umbrella 120 when it is in the closed position. The container 110 may be of any shape suitable for housing the umbrella 120, including, for example, a cylinder, a cube, and a rectangular prism. The container 110 may be made of any material suitable for holding an umbrella, including, for example, metal and polymer. The container 110 is capable of being attached to a person (user) 113. As shown in FIG. 1, the container 110 is attached to the back of the user 113. The container 110 includes a top 111, a bottom 112, a proximal side 114 that is proximal to the user 113, and a distal side 115 that is the side of the container away from the user 113. The container 110 may be covered with a cover 116. The cover 116 may be of any shape suitable for covering the container 110. The cover 116 is attached to the distal side 115 of the container 110 with a hinge 117. Although a hinge 117 is used in this embodiment, the cover 116 may be pivotably attached to the container 110 with any suitable pivot mechanism. When the umbrella 120 moves from the closed position to the open position, the cover 116 pivots about the pivot axis of the hinge 117 so that the portion of the cover 116 above the proximal side 114 of the container 110 moves in direction A up and back to be positioned above the distal side 115 of the container 110. When the umbrella assembly 100 moves from the open position to the closed position, the cover 116 pivots about the pivot axis of the hinge 117 to move in the opposite direction. Positioning the hinge 117 on the distal side 115 of the container 110 avoids having the cover 116 contact the user 113 as the cover 116 opens, but the location of the hinge is not so limited and the hinge 117 may be located on other sides of the container 110.

As discussed above, the umbrella assembly 100 of this embodiment is configured to be attached to the back of a user 113. The container 110 includes at least one strap 118 to harness the container 110 to the shoulders of the user 113, allowing the user 113 to support the umbrella assembly 100 on the back of the user 113. In the embodiment shown in in FIG. 1, the container 110 includes two straps 118, and each strap 118 is attached at two positions on the side proximal to the user 113 (the proximal side 114), one position near the top 111 of the container 110 and another position near the bottom 112 of the container 110. The strap 118 may be made of any material suitable for harnessing onto the user's shoulders, including, for example, woven materials made from either natural or synthetic fibers.

The umbrella 120 includes a canopy 121 that is supported by a shaft 122. The canopy 121 is comprised of piece of material stretched over a stretcher frame 124 and attached to a plurality of ribs 123 that comprise the stretcher frame 124. The canopy 121 may be attached to the stretcher frame 124 by way of any suitable method of adherence, including, for example, an adhesive, stapling, or loops formed in the underside of the canopy 121 and attached to the ribs 123. The stretcher frame 124 will be described more fully below with reference to FIGS. 5 and 6. The canopy 121 may be of any suitable shape when viewed from above, including, for example, circular, square, and rectangular. Further, the canopy 121 may be made of any suitable material, including, for example, waterproof fabric or plastic. As described more fully below, the shaft 122 of this embodiment remains stationary while certain other components, such as the canopy 121, rotate; thus, the shaft 122 is referred to hereinafter as a fixed shaft 122. When the umbrella 120 is in the open position, the fixed shaft 122 begins to move by expanding upwards in vertical direction B from its minimum height in the closed position to its maximum height in the open position. The height of the fully expanded fixed shaft 122 is preferably at least a minimum height that allows the canopy 121 of the umbrella 120 to expand above the head of the user in order to avoid injuring the user and in order to effectively protect the user from precipitation. The fixed shaft 122 may have any suitable maximum height. The fixed shaft 122 may be of any suitable material, including, for example, plastic, metal, and wood. A base 125 is attached to the fixed shaft 122. When the umbrella assembly 100 is in the closed position, the base 125 of the fixed shaft 122 of the umbrella 120 is connected to the interior side of the bottom 112 of the container 110, as depicted more fully below in FIGS. 2-5. The base 125 of the fixed shaft 122 may be of any suitable shape and any suitable size. The base 125 of the fixed shaft 122 is secured to the container bottom 112.

Figure 2A:
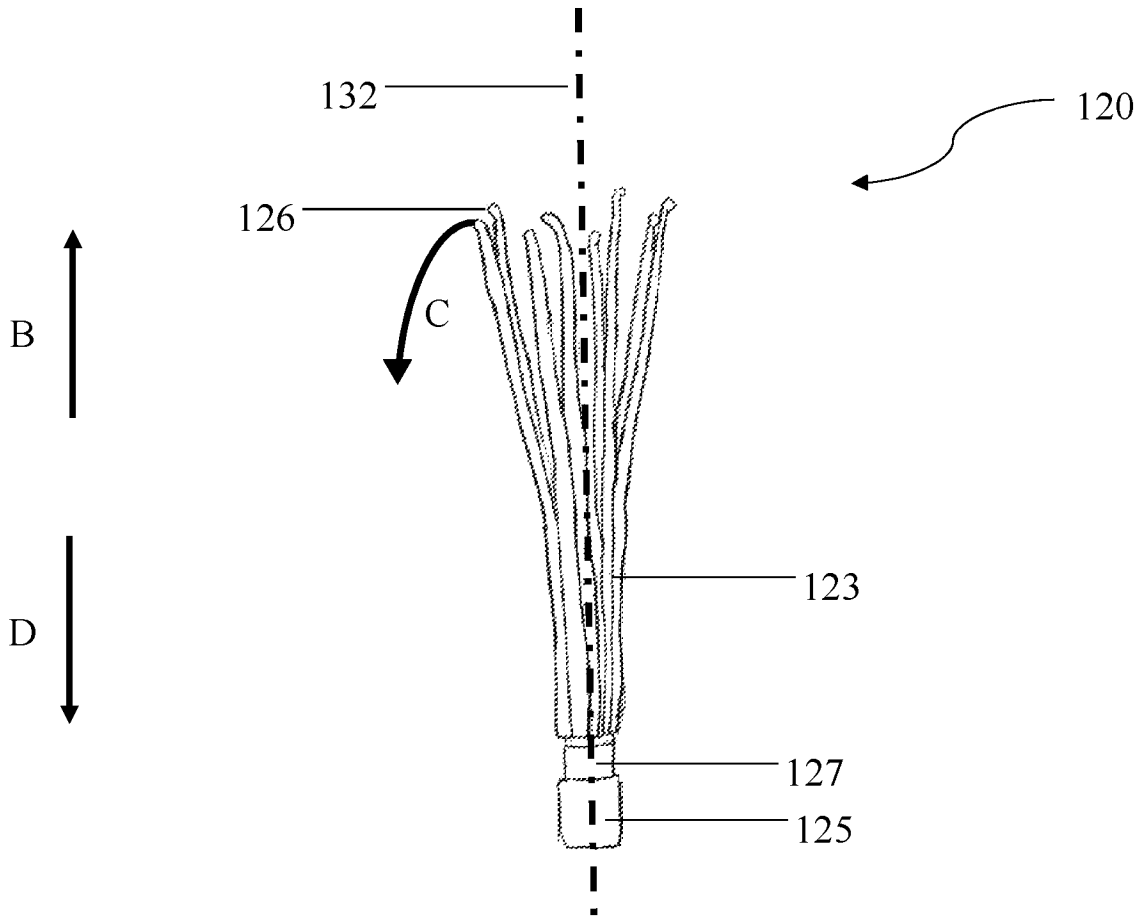
FIGS. 2A-2C illustrate the umbrella shown in FIG. 1 moving from the closed position to the open position.
Figure 2B:
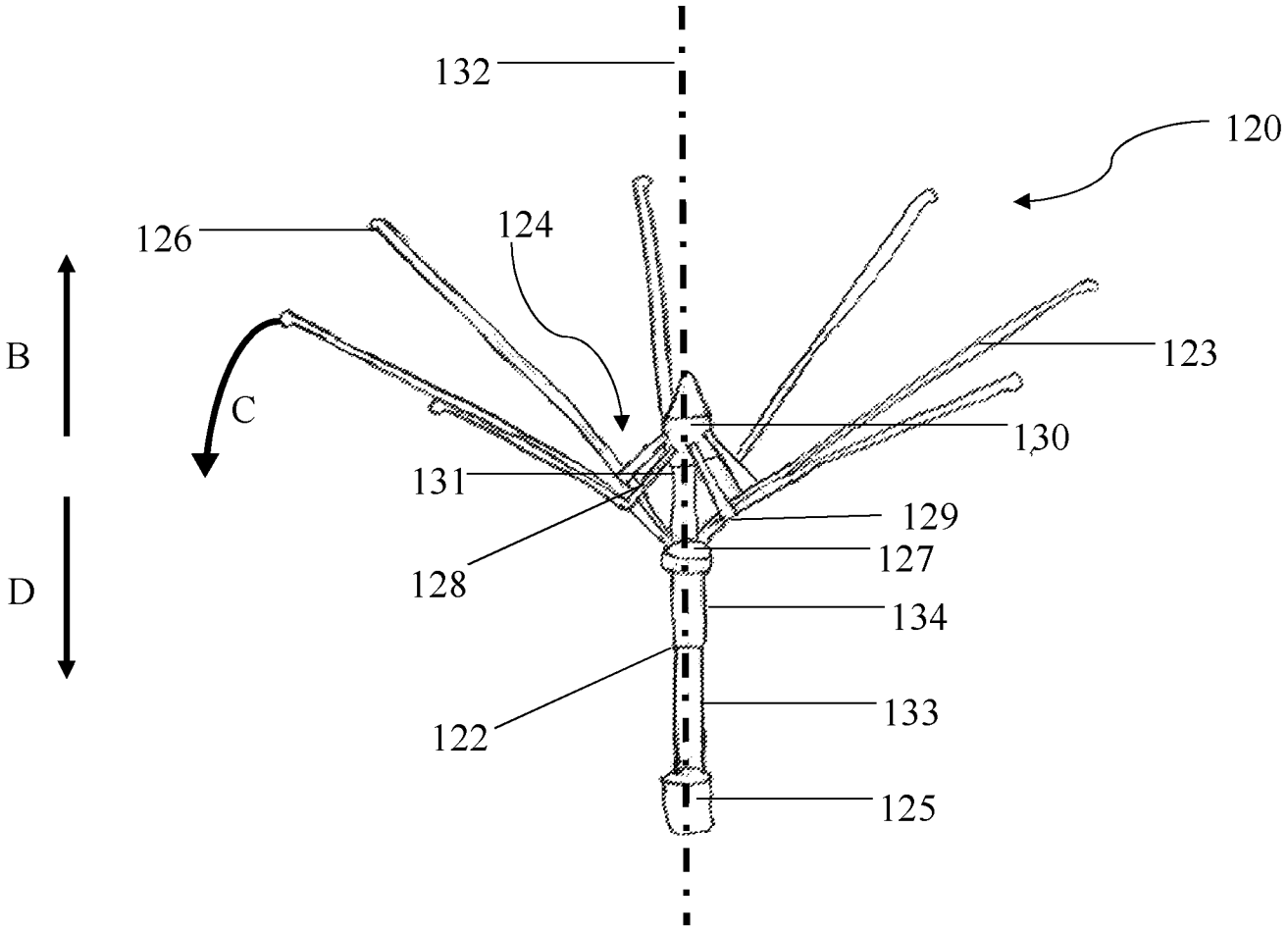
Figure 2C:
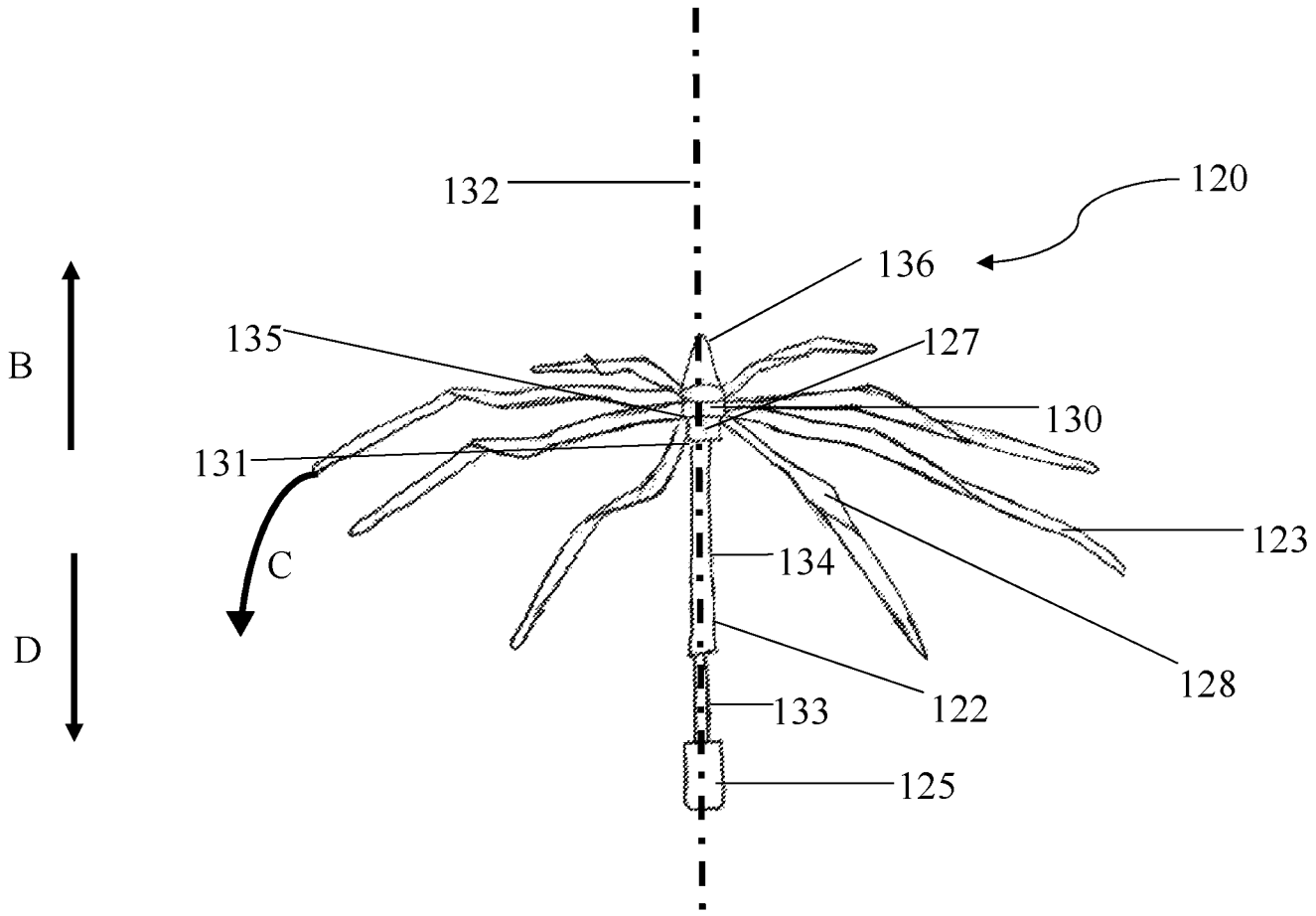

As discussed above, the umbrella 120 is moveable between an open position and a closed position. FIGS. 2A-2C illustrate the umbrella 120 moving from the closed position to the open position. Although the canopy 121 is attached to the fixed shaft 122 by a stretcher frame 124 and the canopy 121 is capable of moving between the open position and closed position, the canopy 121, as well as the container 110, are omitted in FIGS. 2A-2C in order to more clearly illustrate the movement of the umbrella 120 from the closed position to the open position. FIG. 2A illustrates the umbrella 120 in the closed position with a V-shaped, cone arrangement. FIG. 2B shows the umbrella 120 in a partially open position and partially closed position. FIG. 2C shows the umbrella 120 in the open position.

Conventional umbrellas have an A-shaped arrangement in the closed position. During the opening of such conventional umbrellas, the tips of the plurality of ribs move upwards while the canopy expands radially outwards and upwards. If the present umbrella assembly contained a conventional umbrella with an A-shaped arrangement, the user would be at risk of being injured by the stretcher frame and canopy of the umbrella during the expansion of the umbrella. The umbrella 120 of the present embodiment features a reverse close, reverse-open feature in which the contracted position of the umbrella 120 is of a V-shaped, cone arrangement; such an arrangement ensures that the umbrella 120 does not injure the user 113 while moving between the open and closed positions. The umbrella 120 includes the canopy 121 that is supported by a plurality of ribs 123, with each of the plurality of ribs 123 having a tip 126. As will be described more fully below, the V-shaped, cone arrangement allows the tips 126 of each of the plurality of ribs 123 to move downwards in direction C while the canopy 121 expands radially outwards and downwards, also in direction C. The V-shaped, cone arrangement allows the umbrella 120 to expand safely from the container 110 that is harnessed to the shoulders of the user 113 (and therefore proximate to the body of the user 113) and without injuring the user 113. The umbrella 120 may be expanded and contracted by a motor 148 that is powered with the electricity generated from an electrical generator 146, as described more fully below with respect to FIG. 6. Further, the umbrella 120 may be expanded and contracted using a receiver 149, a user input device 150, and a controller 151, as described more fully below with respect to FIG. 6.

The umbrella 120 includes a stretcher frame 124 that has a hub 127 slidably connected to the fixed shaft 122, as best seen in FIG. 2B. A plurality of ribs 123 are pivotably connected to the hub 127 using any suitable pivotable connection. The plurality of ribs 123 may be of any quantity suitable for supporting a canopy. As shown in FIG. 2B, the stretcher frame 124 also includes a plurality of supports 128, each support 128 being pivotably connected on one end to each of the plurality of ribs 123 at rib point 129 and on the other end to an upper support 130. The upper support 130 is connected to the top end 131 of the fixed shaft 122. Each of the plurality of ribs 123 has a tip 126. Along the length of each of the plurality of ribs 123, each tip 126 is located at the point furthest from the point at which the hub 127 is connected to each of the plurality of ribs 123.

FIG. 2A illustrates the umbrella 120 in the closed position with a V-shaped, cone arrangement. The fixed shaft 122 has a vertical axis 132. In the closed position as shown in FIG. 2A, each tip 126 is proximate the vertical axis 132 of the fixed shaft 122. In the V-shaped, cone arrangement, the plurality of ribs 123 radially surround the vertical axis 132 of the fixed shaft 122. Each tip 126 of the plurality of ribs 123 is located at a radial distance away from the vertical axis 132 of the fixed shaft 122 that is equivalent to the radial distances of every other tip of the plurality of ribs. The radial arrangement of the tips 126 of the plurality of ribs 123 resembles the top part of a cone. The radial distances between each of the plurality of ribs 123 and the vertical axis 132 decreases along the length of the ribs 123, which is measured from each tip 126 to the hub 127. The decreasing radial distances resemble the V-shaped part of a cone, thus lending the umbrella 120 the V-shaped, cone arrangement in the closed position.

The fixed shaft 122 has an inner tube 133 and an outer tube 134. When the umbrella 120 is in the open position, as shown in FIG. 2C, the inner tube 133 composes the bottom half of the fixed shaft 122, and the outer tube 134 composes the top half of the fixed shaft 122. The top end 131 of the shaft 122 is located on the outer tube 134. The inner tube 133 and the outer tube 134 each have a diameter, with the diameter of the inner tube being smaller than the diameter of the outer tube such that the inner tube 133 may be slidably nested in the outer tube 134. The inner tube 133 is connected to the base 125 of the fixed shaft 122. When the umbrella 120 moves from the closed position to the open position, the fixed shaft 122 expands to its maximum height. As shown in FIG. 2B, this expansion involves the outer tube 134 sliding vertically upwards in direction B relative to the inner tube 133 and out of inner tube 133 while the base 125 of the fixed shaft 122 remains stationary.

The hub 127 of the stretcher frame 124 is slidably connected to the outer tube 134 of the fixed shaft 122. As the umbrella 120 opens, the hub 127 slides vertically upwards in direction B towards the top end 131 of the outer tube 134. Each of the plurality of ribs 123 expand radially outwards and away from the vertical axis 132 of the fixed shaft 122. In expanding radially outwards, each of the plurality of ribs 123 between the rib point 129 and the hub 127 moves upwards in direction B and closer to support 128 to which it is connected, while each of the plurality of supports 128 simultaneously move downwards in direction C and closer to the rib 123 to which it is connected. Each tip 126 of each of the plurality of ribs 123 moves downwards in direction C while the canopy 121 expands radially outwards and downwards, also in direction C.

The outer tube 134 continues to slide vertically upwards relative to the inner tube 133 until the fixed shaft 122 is expanded to its maximum height. And, likewise, the hub 127 slides fully vertically upwards and until it is positioned at the top end 131 of the outer tube 134. FIG. 2C illustrates the umbrella 120 in the open position. In the open position, the hub 127 is locked through a locking mechanism 135 to the upper support 130 that is connected to the top end 131 of the fixed shaft 122. Each of the plurality of ribs 123 fully expands radially outwards and away from the vertical axis 132 of the fixed shaft 122. Each of the plurality of ribs 123 and each of the plurality of supports 128 also become fully connected between hub 127 and rib point 129. This result is achieved by each of the plurality of supports 128 moving downwards in direction D towards the corresponding rib 123 and each of the plurality of ribs 123 moving upwards in direction B towards the corresponding support 128, as described more fully in FIG. 2B. Thus, in the open position, each of the plurality of supports 128 rests on top of the rib 123 to which it is connected and rests on the section of the rib 123 that spans hub 127 and rib point 129.

The outer tube 134 continues to slide vertically upwards relative to the inner tube 133 until the fixed shaft 122 is expanded to its maximum height. And, likewise, the hub 127 slides fully vertically upwards and until it is positioned at the top end 131 of the outer tube 134. FIG. 2C illustrates the umbrella 120 in the open position. In the open position, the hub 127 is locked through a locking mechanism 135 to the upper support 130 that is connected to the top end 131 of the fixed shaft 122. Each of the plurality of ribs 123 fully expands radially outwards and away from the vertical axis 132 of the fixed shaft 122. Each of the plurality of ribs 123 and each of the plurality of supports 128 also become fully connected between hub 127 and rib point 129. This result is achieved by each of the plurality of supports 128 moving downwards in direction D towards the corresponding rib 123 and each of the plurality of ribs 123 moving upwards in direction B towards the corresponding support 128, as described more fully in FIG. 2B. Thus, in the open position, each of the plurality of supports 128 rests on top of the rib 123 to which it is connected and rests on the section of the rib 123 that spans hub 127 and rib point 129.

Any suitable mechanism may be used to open and close the umbrella 120. In this embodiment, an electrical motor 148 (see FIG. 6) is configured to expand the umbrella 120 from the closed to the open positions in FIGS. 2A-2C. The motor 148 is configured to drive the outer tube 134 and the hub 127 up and down.

Figure 3:
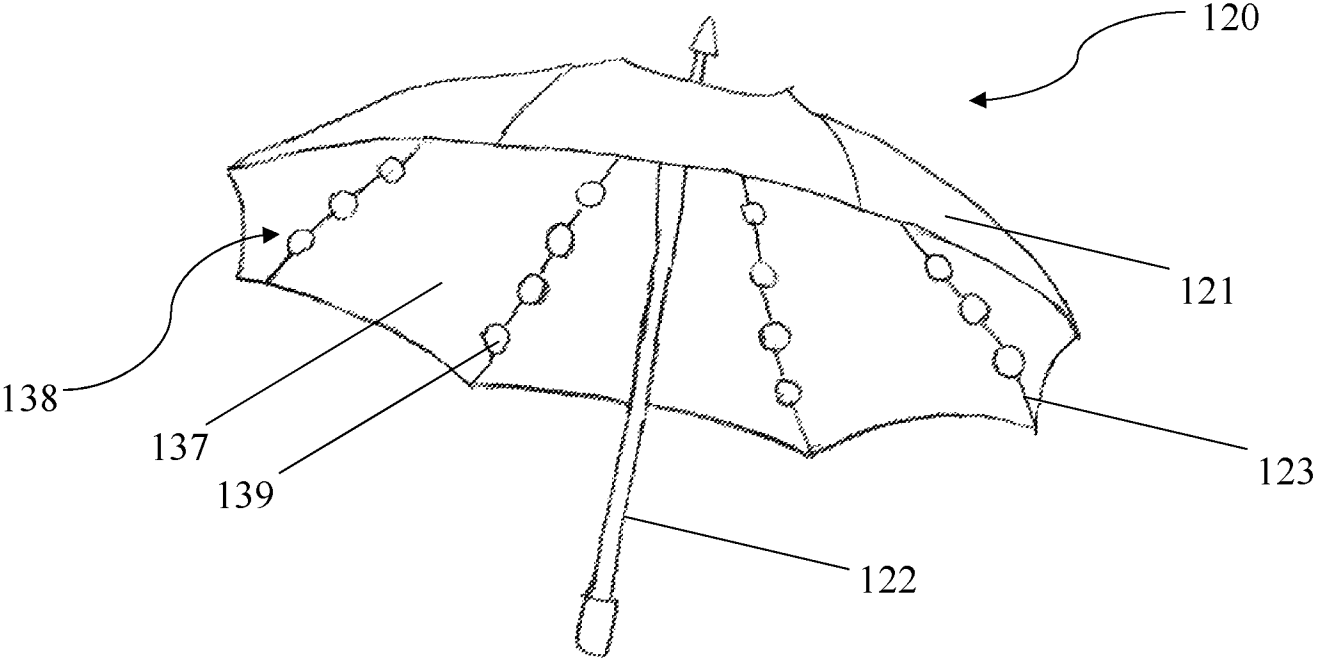
FIG. 3 is a perspective view of the umbrella assembly showing a bottom side of the umbrella in the open position.

The umbrella assembly 100 may also be equipped with lights that provide various advantages, such as ensuring visibility of the user 113 at night and during precipitation. One such light is a first lighting mechanism 138. FIG. 3 is a perspective view of the umbrella assembly 100 showing a bottom side 137 of the umbrella 120 in the open position. The first lighting mechanism 138 is located on the bottom side 137 of the canopy 121. The first lighting mechanism 138 is located as such in order to maximize visibility in two ways. First, the first lighting mechanism 138 alerts vehicle drivers, bicyclists, and other pedestrians of the presence of the user 113 by making the user 113 more conspicuous, particularly at night, during precipitation, and other unsafe conditions. Second, in similarly unsafe conditions, the first lighting mechanism 138 improves the visibility of the user 113 by illuminating the path being taken by the user 113. In this embodiment, the first lighting mechanism 138 includes a plurality of lights 139 that are spaced along at least one of the plurality of ribs 123. In a preferred embodiment, each rib 123 of the plurality of ribs 123 includes at least three lights 139 that are equally spaced along each rib 123, but the invention is not limited to this embodiment and may include a different number and arrangement of the plurality of lights 139 along the plurality of ribs 123. The first lighting mechanism 138 may be composed of lights of any suitable type and arranged in any suitable manner. The first lighting mechanism 138 may further be composed of individual lights encased in any suitable material, including, for example, glass and plastic. Such suitable lights may include, for example, fluorescent lights, light emitting diodes, and neon lights. In a preferred embodiment, the first lighting mechanism 138 is composed of neon lights in order to optimize visibility and improve the safety of the user 113. Instead of discrete lights, the first lighting mechanism may also be composed of an electroluminescent wire. The first lighting mechanism 138 may be activated and deactivated by a user-selectable element 152 and powered by a power source 147. The user-selectable element 152 may be remotely operated using a receiver 149, a user input device 150, and a controller 151, as described more fully below with respect to FIG. 6. The power source 147 may be any suitable power source such as a battery or an electrical generator 146, as described more fully below with respect to FIG. 6.

Figure 4:
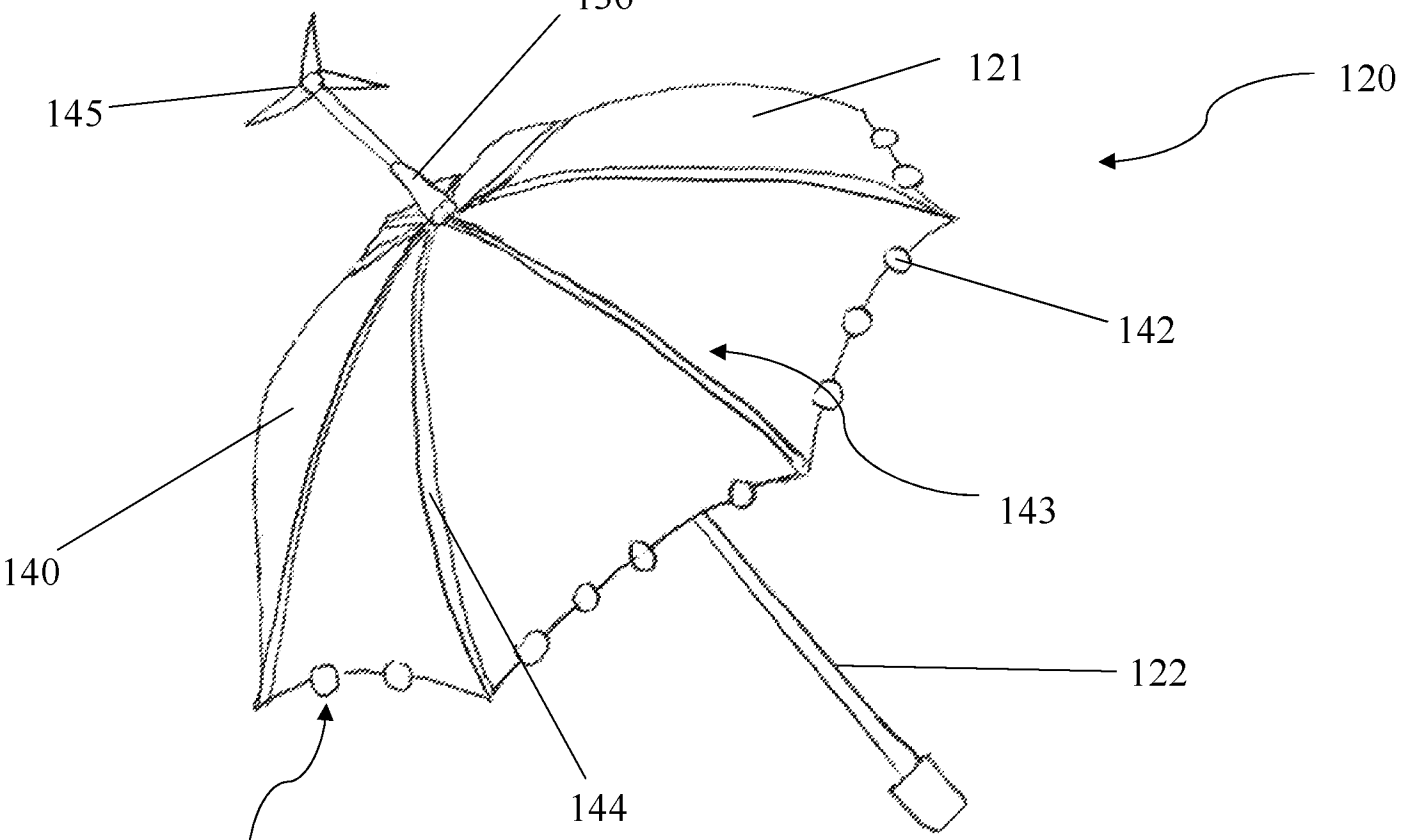
FIG. 4 is a perspective view of the umbrella assembly showing the top side of the umbrella in the open position.

The umbrella assembly 100 may include a second lighting mechanism 141. FIG. 4 is a perspective view of the umbrella assembly 100 showing the top side 140 of the umbrella 120 in the open position. The second lighting mechanism 141 is fixed on the perimeter of the canopy 121 and includes a plurality of lights 142 that are spaced on the perimeter of the canopy 121. The second lighting mechanism 141 is located as such in order to maximize visibility in two ways. First, the second lighting mechanism 141 alerts vehicle drivers, bicyclists, and other pedestrians of the presence of the user 113 by making both the user 113 and the umbrella 120 more conspicuous, particularly at night, during precipitation, and other unsafe conditions. Second, in similarly unsafe conditions, the second lighting mechanism 141 improves the visibility of the user 113 by illuminating the path being taken by the user 113 and the surroundings of the user 113. The second lighting mechanism 141 may include a plurality of lights 142 that are spaced on the full perimeter of the canopy 121 or on a partial perimeter of the canopy 121. The second lighting mechanism 141 may be composed of lights of any suitable type and arranged in any suitable manner. The second lighting mechanism 141 may further be composed of individual lights encased in any suitable material, including, for example, glass and plastic. Such suitable lights may include, for example, fluorescent lights, light emitting diodes, and neon lights. In a preferred embodiment, the second lighting mechanism 141 is composed of neon lights in order to optimize visibility and improve the safety of the user 113. The second lighting mechanism 141 may also be composed of an electroluminescent wire. The second lighting mechanism 141 may be activated and deactivated by a user-selectable element 152 and powered by the power source 147. As with the first lighting mechanism 138, the second lighting mechanism 141 may be remotely operated using the receiver 149, the user input device 150, and the controller 151, as described more fully below with respect to FIG. 6. The second lighting mechanism 141 also may be powered by the electricity generated from the electrical generator 146, as described more fully below with respect to FIG. 6.

The umbrella assembly 100 may also include a third lighting mechanism 143. The third lighting mechanism 143 is fixed on the top side 140 of the canopy 121 and includes a plurality of lights 144 as can be seen in FIG. 4. In this embodiment, the plurality of lights 144 of the third lighting mechanism 143 are fixed along the part of the top side 140 of the canopy 121 that directly covers the plurality of ribs 123. The third lighting mechanism 143 is located as such in order to maximize visibility in two ways. First, the third lighting mechanism 143 indirectly alerts vehicle drivers, bicyclists, and other pedestrians of the presence of the user 113 by making the umbrella 120 more conspicuous, particularly at night, during precipitation, and other unsafe conditions. Second, in similarly unsafe conditions, the third lighting mechanism 143 improves the visibility of the user 113 by illuminating the surroundings of the user 113. The third lighting mechanism 143 may be composed of lights of any suitable type and arranged in any suitable manner. The third lighting mechanism 143 may further be composed of individual lights encased in any suitable material, including, for example, glass and plastic. Such suitable lights may include, for example, fluorescent lights, light emitting diodes, and neon lights. In a preferred embodiment, the third lighting mechanism 143 is composed of neon lights in order to optimize visibility and improve the safety of the user 113. The third lighting mechanism 143 may also be composed of an electroluminescent wire. The third lighting mechanism 143 may be activated and deactivated by a user-selectable element 152 and powered by a power source 147. As with the first lighting mechanism 138, the third lighting mechanism 143 may be remotely operated using the receiver 149, the user input device 150, and the controller 151, as described more fully below with respect to FIG. 6. The third lighting mechanism 143 may be powered by the electricity generated from the electrical generator 146, as described more fully below with respect to FIG. 6.

As discussed above, the umbrella assembly 100 includes various features that are powered by electricity, such as the motor 148 to open and close the umbrella 120 and the lights (first lighting mechanism 138, second lighting mechanism 141, and third lighting mechanism 143). The umbrella assembly 100 of this embodiment may power these devices by wind and thus further includes a rotating device 145. In the open position, the umbrella 120 has a peak 136. The rotating device 145 is fixed on the peak 136 of the umbrella 120. The rotating device 145 may be of any shape suitable for being rotated by wind, including, for example, a wheel and a windmill. The rotating device 145 is connected to an electrical generator 146 (see FIG. 6), such that, when the rotating device 145 rotated by the wind, the electrical generator 146 generates electricity.

Figure 5:
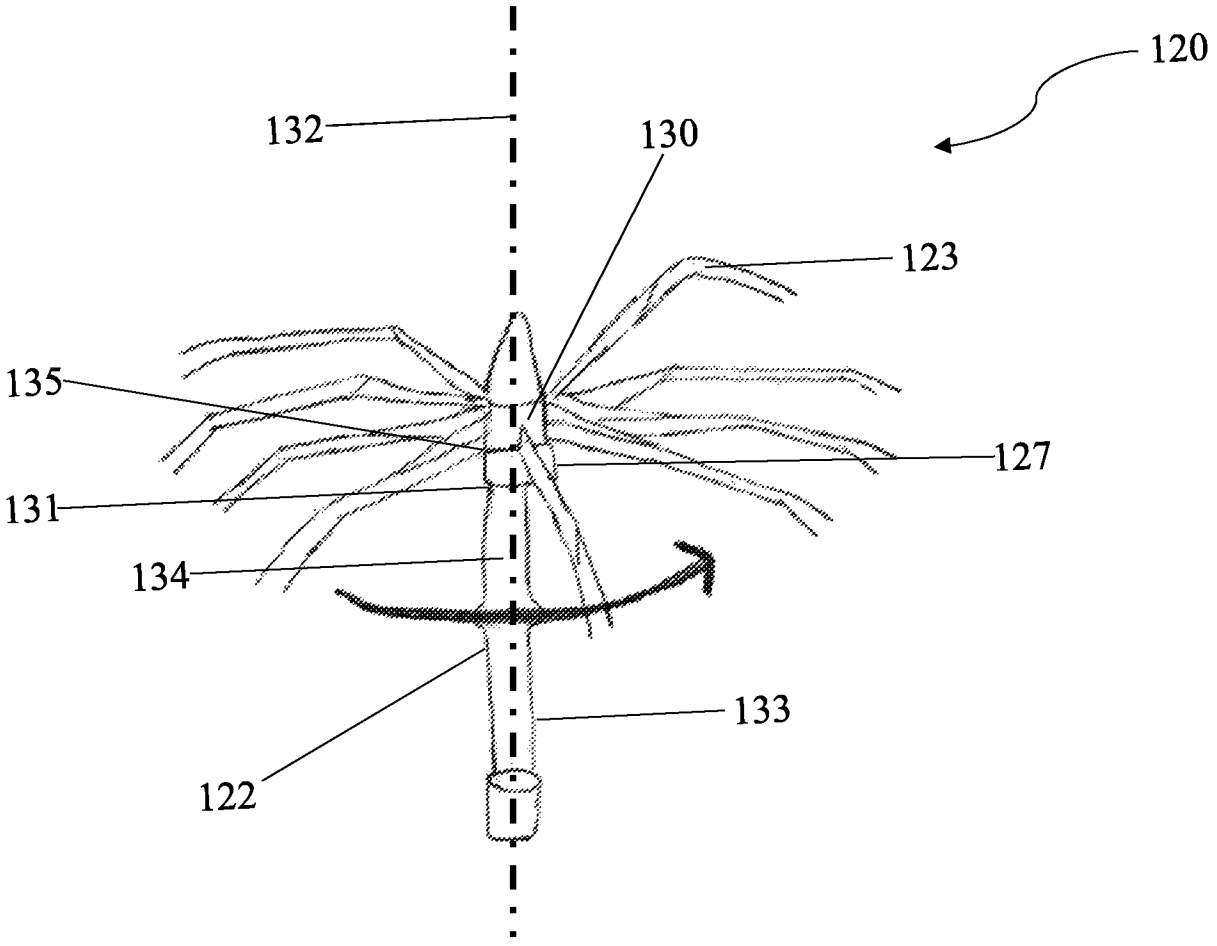
FIG. 5 is a side view of the umbrella assembly.

The umbrella 120 of the umbrella assembly 100 also rotates about the fixed shaft 122, which will be described with reference to FIG. 5. FIG. 5 is a side view of the umbrella assembly 100. The canopy 121 is omitted in order to more clearly illustrate the rotation of the umbrella 120. When the umbrella 120 is in the open position, the hub 127 slides fully vertically upwards and is located at the top end 131 of the outer tube 134. In the open position, the canopy 121, the stretcher frame 124, the hub 127 and the plurality of ribs 123 (collectively referred to as the rotatable components) are rotatable about the vertical axis 132 of the fixed shaft 122. The rotation of the rotatable components about the vertical axis 132 of the fixed shaft 122 is illustrated in FIG. 5 using a curved arrow. The rotation of the rotatable components allows the umbrella 120 to resist strong and heavy winds, as well as dries the umbrella 120 after precipitation is over and prior to contraction of the umbrella 120. The rotatable components can be locked through a locking mechanism 135 to the upper support 130 that is connected to the top end 131 of the fixed shaft 122, such that the rotatable components are not able to rotate about the shaft 122. As with the lights and the opening and closing of the umbrella, the locking mechanism 135 may be released and the rotation may be activated remotely by the receiver 149, the user input device 150, and the controller 151, as described more fully below with respect to FIG. 6. Furthermore, the locking mechanism 135 also may be secured and the rotation also may be deactivated also remotely by the receiver 149, the user input device 150, and the controller 151, as described more fully below with respect to FIG. 6.

Figure 6:
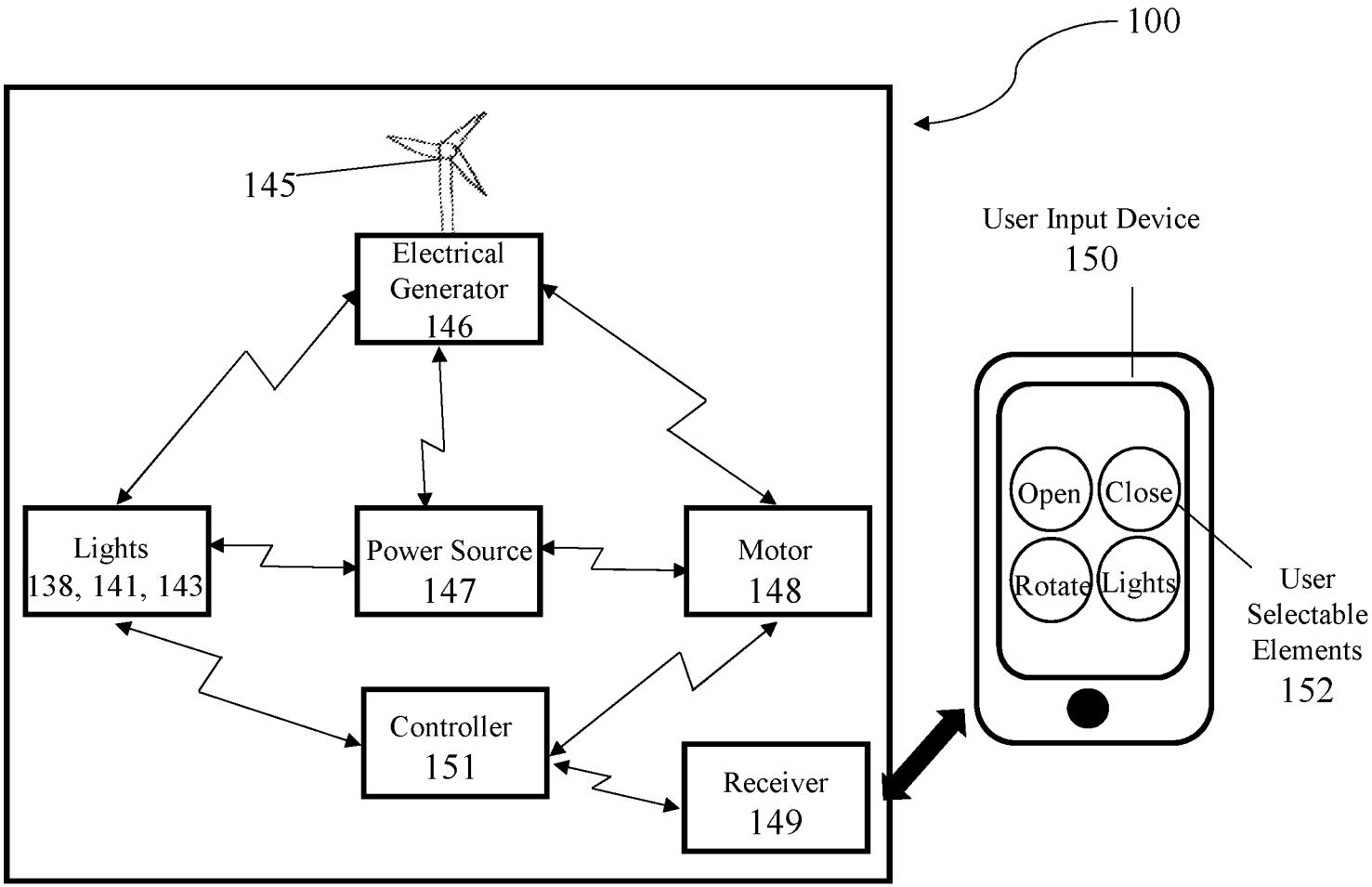
FIG. 6 is a schematic block diagram of the umbrella assembly.

As discussed above, the umbrella assembly 100 includes various electrical components. FIG. 6 is a schematic block diagram of the umbrella assembly 100 in accordance with a preferred embodiment of the invention. The umbrella assembly 100 includes an electrical generator 146 that may optionally store electricity in a power source 147. The rotating device 145 is connected to the electrical generator 146 such that when the rotating device 145 is rotated by the wind, the electrical generator 146 generates electricity. The electricity may be stored in the power source 147 such as a battery or, when the battery is omitted, directly used to power the electrical components discussed herein. The motor 148 is used to drive the components of the umbrella assembly 100 to open and close the umbrella 120. The motor 148 is powered by the electricity generated by the electrical generator 146 either directly from the electrical generator 146 or indirectly from the electrical generator 146 via the power source 147. Likewise, the first lighting mechanism 138, second lighting mechanism 141, and the third lighting mechanism 143 may be powered either directly from the electrical generator 146 or indirectly from the electrical generator 146 via the power source 147. The electrical connections discussed herein may exist by way of any suitable material, including, for example, electrical wires.

As discussed above, the umbrella assembly 100 may be remotely operated in an easy and convenient manner. As shown in FIG. 6, the umbrella assembly 100 includes a receiver 149 configured to receive a plurality of user inputs from a user input device 150 and a controller 151, communicatively coupled to the receiver 149. The controller 151 is configured to control the umbrella assembly in response to an input received by the receiver 149 from the user input device 150. The user input device 150 may be of any suitable type, including, for example, a wireless remote control or a mobile application on a mobile phone. The user input device 150 includes a plurality of user-selectable elements 152. These user-selectable elements may be buttons, switches or the like. Where the user input device 150 includes a touch screen, such as a mobile phone, the user-selectable elements 152 may be virtual buttons displayed on the screen of the touch screen. When a user 113 selects one of the user-selectable elements 152, the user input device 150 communicates with the umbrella assembly 100 to transmit (via an unshown transmitter) a user input. The receiver 149 is configured to receive the plurality of user inputs from the transmitter of the user input device 150 using any suitable wireless communication protocol known in the art, including, for example, radio transmission and Bluetooth. Although discussed as using wireless communication protocols, the invention is not so limited, and the user inputs may be communicated to the umbrella assembly 100 using any suitable method. The controller 151 may be of any suitable type, including, for example, microprocessor-based or an electrical circuit. The controller 151 is communicatively coupled to the receiver and operates the umbrella assembly 100 in response to a user input received by the receiver.

In this embodiment, the user-selectable elements 152 include, open, close, rotate, and lights. The receiver 149 is configured to receive the plurality of user inputs from the user input device 150, including an open command, a close command, a rotate command, and a lights command, respectively, when the user 113 selects one the user-selectable elements 152. When the receiver 149 receives the open command from the user input device 150, the controller 151 is configured to control the motor 148 to move the umbrella from the closed position to the open position. When the receiver 149 receives the closed command from the user input device 150, the controller 151 is configured to control the motor 148 to move the umbrella from the open position to the closed position. When the receiver 149 receives the rotate command from the user input device 150, the controller 151 allows the canopy 121, the stretcher frame 124, the hub 127 and the plurality of ribs 123 to rotate. In this embodiment, the controller 151, in response to the rotate command, disengages the locking mechanism 135 allowing the rotatable components to rotate. When the receiver 149 receives the lights command from the user input device 150, the controller 151 activates or deactivates at least one of the first lighting mechanism 138, the second lighting mechanism 141, and the third lighting mechanism 143. Although shown with one user-selectable element 152 for lights, a plurality of user-selectable elements for lights may be used, including, for example, a user-selectable element 152 to operate each of the of the first lighting mechanism 138, the second lighting mechanism 141, and the third lighting mechanism 143.

Although this invention has been described with respect to certain figures in accordance with an embodiment of the present disclosure, and such figures include various combinations of the invention's features, it is to be understood that this invention may be practiced, be made, and be used without every feature that has been included in the above figures. For example, although FIG. 4 includes both the second lighting mechanism, the third lighting mechanism, and the rotating device, the invention may be practiced without any one or more of the three features.

Furthermore, although this invention has been described with respect to certain figures in accordance with an embodiment of the present disclosure, many additional modifications and variations will be apparent to those skilled in the art in light of this disclosure. It is therefore to be understood that this invention may be practiced otherwise than as specifically described.

What is claimed is:

1. An umbrella assembly comprising:

(A) a container having a top and a bottom;

(B) at least one shoulder strap attached to the container and capable of harnessing the container onto the shoulders of a user;

(C) an umbrella movably connected to the container to move between a closed position and an open position, the umbrella including:

(a) a fixed shaft having a vertical axis, an inner tube, and an outer tube, the inner tube composing the bottom half of the shaft, the outer tube having a top end and composing the top half of the shaft, the inner tube and the outer tube each having a diameter, the diameter of the inner tube being smaller than the diameter of the outer tube such that the inner tube may be slidably nested in the outer tube;

(b) a stretcher frame configured to rotate about the vertical axis of the fixed shaft, the stretcher frame having (i) a hub slidably connected to the shaft and (ii) a plurality of ribs connected to the hub, each rib of the plurality of ribs having a tip; and (c) a canopy attached to the plurality of ribs of the stretcher frame, wherein, in the closed position, the stretcher frame and the canopy have a V-shaped, cone arrangement with the tips of each of the plurality of ribs being proximate the vertical axis of the fixed shaft, wherein, in the open position, the umbrella has a peak at a central point of the stretcher frame, wherein, when the umbrella moves from the closed position to the open position, the inner tube and the outer tube slide relative to each other, the hub slides upward toward the top end of the outer tube, the canopy and the ribs expand radially outwards and downwards from the V-shaped, cone arrangement and away from the vertical axis of the fixed shaft, and the tips of each of the plurality of ribs move downwards and away from the vertical axis of the fixed shaft, and wherein, when the umbrella moves from the open position to the closed position, the inner tube of the shaft slides into the outer tube of the shaft, the hub slides downward away from the top end of the outer tube, the canopy and the ribs contract inwards and upwards to form the V-shaped, cone arrangement and towards the vertical axis of the fixed shaft, and the tips of each of the plurality of ribs move upwards and towards the vertical axis of the fixed shaft;

(D) a rotating device mounted on the peak of the umbrella, wherein, when the umbrella is in the open position, the rotating device is capable of being rotated by wind to generate electricity; and (E) an electrical generator connected to the rotating device such that, when the rotating device is rotated by wind, the electrical generator generates electricity.

2. The umbrella assembly of claim 1, wherein the rotating device is one of a wheel or a windmill.

3. The umbrella assembly of claim 1, further comprising (F) a motor that is electrically connected to the electrical generator and configured to be powered by the electricity generated by the electrical generator, the motor being configured to move the umbrella between the open position and the closed position.

4. The umbrella assembly of claim 3, further comprising:
(G) a receiver configured to receive a plurality of user inputs including an open command and a close command; and
(H) a controller communicatively coupled to the receiver and configured to control the motor such that
(i) when the receiver receives the open command, the controller operates the motor to move the umbrella from the closed position to the open position, and
(ii) when the receiver receives the close command, the controller operates the motor to move the umbrella from the open position to the closed position.

5. The umbrella assembly of claim 1, further comprising:
(F) a receiver configured to receive at least one user input; and
(G) a controller communicatively coupled to the receiver and configured to control an aspect of the umbrella assembly in response to an input received by the receiver.

6. The umbrella assembly of claim 5,
wherein the at least one user input includes a rotate command, and
wherein, when the receiver receives the rotate command, the controller allows the stretcher frame and canopy of the umbrella to rotate.

7. The umbrella assembly of claim 5, further comprising (H) at least one lighting mechanism, wherein the at least one user input includes a lights command, and, when the receiver receives the lights command, the controller activates or deactivates at least one lighting mechanism.

8. The umbrella assembly of claim 5, wherein the receiver is configured to receive the at least one user input using a wireless communication protocol.

9. An umbrella assembly comprising:
(A) a container having a top and a bottom;
(B) at least one shoulder strap attached to the container and capable of harnessing the container onto the shoulders of a user;
(C) an umbrella movably connected to the container to move between a closed position and an open position, the umbrella including:
(a) a fixed shaft having a vertical axis, an inner tube, and an outer tube, the inner tube composing the bottom half of the shaft, the outer tube having a top end and composing the top half of the shaft, the inner tube and the outer tube each having a diameter, the diameter of the inner tube being smaller than the diameter of the outer tube such that the inner tube may be slidably nested in the outer tube;
(b) a stretcher frame configured to rotate about the vertical axis of the fixed shaft, the stretcher frame having (i) a hub slidably connected to the shaft and (ii) a plurality of ribs connected to the hub, each rib of the plurality of ribs having a tip; and
(c) a canopy attached to the plurality of ribs of the stretcher frame, the canopy having a perimeter, a top side, and a bottom side,
wherein, in the closed position, the stretcher frame and the canopy have a V-shaped, cone arrangement with the tips of each of the plurality of ribs being proximate the vertical axis of the fixed shaft,
wherein, in the open position, the umbrella has a peak at a central point of the stretcher frame,
wherein, when the umbrella moves from the closed position to the open position, the inner tube and the outer tube slide relative to each other, the hub slides upward toward the top end of the outer tube, the canopy and the ribs expand radially outwards and downwards from the V-shaped, cone arrangement and away from the vertical axis of the fixed shaft, and the tips of each of the plurality of ribs move downwards and away from the vertical axis of the fixed shaft, and
wherein, when the umbrella moves from the open position to the closed position, the inner tube of the shaft slides into the outer tube of the shaft, the hub slides downward away from the top end of the outer tube, the canopy and the ribs contract inwards and upwards to form the V-shaped, cone arrangement and towards the vertical axis of the fixed shaft, and the tips of each of the plurality of ribs move upwards and towards the vertical axis of the fixed shaft;
(D) a first lighting mechanism fixed on the bottom side of the canopy; and
(E) a second lighting mechanism fixed on the perimeter of the canopy.

10. The umbrella assembly of claim 9, further comprising:
(F) a rotating device capable of being rotated by wind to generate electricity; and
(G) an electrical generator connected to the rotating device such that, when the rotating device is rotated by wind, the electrical generator generates electricity to power the first lighting mechanism and the second lighting mechanism.

11. The umbrella assembly of claim 9, further comprising (F) a third lighting mechanism fixed on the top side of the canopy.

12. The umbrella assembly of claim 9, wherein the first lighting mechanism includes a plurality of lights that are spaced along at least one of the plurality of ribs.

13. The umbrella assembly of claim 9, wherein the second lighting mechanism includes a plurality of lights that are spaced on the full perimeter of the canopy.

14. The umbrella assembly of claim 9, wherein at least one of the first lighting mechanism and the second lighting mechanism is an electroluminescent wire.

15. The umbrella assembly of claim 9, further comprising:
(F) a receiver configured to receive a plurality of user inputs including an open command and a close command; and
(G) a controller communicatively coupled to the receiver and configured to control the umbrella such that
(i) when the receiver receives the open command, the controller moves the umbrella from the closed position to the open position, and
(ii) when the receiver receives the close command, the controller controls the moving of the umbrella from the open position to the closed position.

16. The umbrella assembly of claim 9, further comprising:
(F) a receiver configured to receive at least one user input including a rotate command; and
(G) a controller communicatively coupled to the receiver such that when the receiver receives the rotate command, the controller allows the stretcher frame and canopy of the umbrella to rotate.

17. The umbrella assembly of claim 9, further comprising:
(F) a receiver configured to receive at least one user input including a lights command; and
(G) a controller communicatively coupled to the receiver such that when the receiver receives the lights command, the controller activates or deactivates at least one lighting mechanism.

18. The umbrella assembly of claim 9, further comprising:

(F) a receiver configured to receive at least one user input using at least one wireless communication protocol; and (G) a controller communicatively coupled to the receiver and configured to control the umbrella in response to an input received by the receiver.

19. The umbrella assembly of claim 9, wherein the second lighting mechanism includes a plurality of safety lights.

20. An umbrella assembly comprising:

(A) a container having a top and a bottom;

(B) at least one shoulder strap attached to the container;

(C) an umbrella movably connected to the container to move between a closed position and an open position, the umbrella including:

(a) a fixed shaft having a vertical axis, an inner tube, and an outer tube, the inner tube composing the bottom half of the shaft, the outer tube having a top end and composing the top half of the shaft, the inner tube and the outer tube each having a diameter, the diameter of the inner tube being smaller than the diameter of the outer tube such that the inner tube may be slidably nested in the outer tube;

(b) a stretcher frame configured to rotate about the vertical axis of the fixed shaft, the stretcher frame having (i) a hub slidably connected to the shaft and (ii) a plurality of ribs connected to the hub, each rib of the plurality of ribs having a tip; and (c) a canopy attached to the plurality of ribs of the stretcher frame, wherein, in the closed position, the stretcher frame and the canopy have a V-shaped, cone arrangement with the tips of each of the plurality of ribs being proximate the vertical axis of the fixed shaft, wherein, when the umbrella moves from the closed position to the open position, the inner tube and the outer tube slide relative to each other, the hub slides upward toward the top end of the outer tube, the canopy and the ribs expand radially outwards and downwards from the V-shaped, cone arrangement and away from the vertical axis of the fixed shaft, and the tips of each of the plurality of ribs move downwards and away from the vertical axis of the fixed shaft, and wherein, when the umbrella moves from the open position to the closed position, the inner tube of the shaft slides into the outer tube of the shaft, the hub slides downward away from the top end of the outer tube, the canopy and the ribs contract inwards and upwards to form the V-shaped, cone arrangement and towards the vertical axis of the fixed shaft, and the tips of each of the plurality of ribs move upwards and towards the vertical axis of the fixed shaft.

* * * * *